United States Patent [19]

Parker et al.

[11] Patent Number: 5,038,177

[45] Date of Patent: Aug. 6, 1991

[54] SELECTIVE PRE-TRANSFER CORONA TRANSFER WITH LIGHT TREATMENT FOR TRI-LEVEL XEROGRAPHY

[75] Inventors: Delmer G. Parker, Rochester; William M. Allen, Jr., Webster; Gerald M. Fletcher, Pittsford; James E. Williams, Rochester, all of N.Y.

[73] Assignee: Xerox Corporation, Stamford, Conn.

[21] Appl. No.: 284,870

[22] Filed: Dec. 15, 1988

[51] Int. Cl.[5] ..... G03G 15/14; G03G 21/00

[52] U.S. Cl. ..... 355/273; 355/266

[58] Field of Search ..... 355/210, 220, 271, 273, 355/266

[56] References Cited

U.S. PATENT DOCUMENTS

| | | | |
|---|---|---|---|
| 3,444,369 | 5/1969 | Malinaric | 250/326 X |
| 3,558,307 | 1/1971 | Carlson | 355/210 X |
| 3,612,681 | 10/1971 | Itoh | 355/210 |
| 3,784,300 | 1/1974 | Hudson et al. | 355/273 |
| 4,039,257 | 8/1977 | Connolly | 355/273 |
| 4,078,929 | 3/1978 | Gundlach | 430/42 |
| 4,205,322 | 5/1980 | Truzuki et al. | 346/153 |
| 4,482,240 | 11/1984 | Kuge et al. | 355/274 |
| 4,506,971 | 3/1985 | Buell et al. | 355/294 |
| 4,761,672 | 8/1988 | Parker et al. | 355/220 |
| 4,847,655 | 7/1989 | Parker et al. | 355/210 |
| 4,937,630 | 6/1990 | Yoshikawa et al. | 355/273 |

*Primary Examiner*—Fred L. Braun

[57] ABSTRACT

Balanced, efficient corona transfer for both the charged area image and the discharged area image of a developed tri-level image is obtained by the provision of a selective pre-transfer charge corona device in combination with a pre-transfer discharge lamp. While improved transfer over prior art devices is obtained using a pre-transfer lamp prior to pre-transfer charging the preferred embodiment of the invention utilizes a pre-transfer lamp before and in coincidence with pre-transfer charging.

11 Claims, 3 Drawing Sheets

SELECTIVE PRE-TRANSFER CORONA TRANSFER WITH LIGHT TREATMENT FOR TRI-LEVEL XEROGRAPHY

BACKGROUND OF THE INVENTION

This invention relates generally to tri-level imaging and more particularly to a method and apparatus for more efficiently transferring a tri-level image from a charge retentive surface to a substrate such as plain paper.

In the practice of conventional xerography, it is the general procedure to form electrostatic latent images on a xerographic surface by first uniformly charging a charge retentive surface such as a photoreceptor. Only the imaging area of the photoreceptor is uniformly charged. The image area does not extend across the entire width of the photoreceptor. Accordingly, the edges of the photoreceptor are not charged. The charged area is selectively dissipated in accordance with a pattern of activating radiation corresponding to original images. The selective dissipation of the charge leaves a latent charge pattern on the imaging surface corresponding to the areas not exposed by radiation.

This charge pattern is made visible by developing it with toner by passing the photoreceptor past a single developer housing. The toner is generally a colored powder which adheres to the charge pattern by electrostatic attraction. The developed image is then fixed to the imaging surface or is transferred to a receiving substrate such as plain paper to which it is fixed by suitable fusing techniques.

In tri-level, highlight color imaging, unlike conventional xerography, the image area contains three voltage levels which correspond to two image areas and to a background voltage area. One of the image areas corresponds to non-discharged (i.e. charged) areas of the photoreceptor while the other image areas correspond to discharged areas of the photoreceptor.

The concept of tri-level, highlight color xerography is described in U.S. Pat. No. 4,078,929 issued in the name of Gundlach. The patent to Gundlach teaches the use of tri-level xerography as a means to achieve single-pass highlight color imaging. As disclosed therein the charge pattern is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development systems are biased to about the background voltage. Such biasing results in a developed image of improved color sharpness.

In highlight color xerography as taught by Gundlach, the xerographic contrast on the charge retentive surface or photoreceptor is divided three, rather than two, ways as is the case in conventional xerography. The photoreceptor is charged, typically to 900 v. It is exposed imagewise, such that one image corresponding to charged image areas (which are subsequently developed by charged-area development, i.e. CAD) stays at the full photoreceptor potential ($V_{cad}$ or $V_{ddp}$, shown in FIG. 1*a*). The other image is exposed to discharge the photoreceptor to its residual potential, i.e. $V_{dad}$ or $V_c$ (typically 100 v) which corresponds to discharged area images that are subsequently developed by discharged-area development (DAD) and the background areas exposed such as to reduce the photoreceptor potential to halfway between the $V_{cad}$ and $V_{dad}$ potentials, (typically 500 v) and is referred to as $V_{white}$ or $V_w$. The CAD developer is typically biased about 100 v ($V_{bb}$, shown in FIG. 1*b*) closer to $V_{cad}$ than $V_{white}$ (about 600 v), and the DAD developer system is biased about 100 v ($V_{cb}$, shown in FIG. 1*b*) closer to $V_{dad}$ than $V_{white}$ (about 400 v).

As developed, the composite tri-level image initially consists of both positive and negative toners. To enable conventional corona transfer, it is necessary to first convert the entire image to the same polarity. This must be done without overcharging the toner that already has the correct polarity for transfer. If the amount of charge on the toner becomes excessive, normal transfer will be impaired and the coulomb forces may cause toner disturbances in the developed image. On the other hand, if the toner whose polarity is being reversed is not charged sufficiently its transfer efficiency will be poor and the transferred image will be unsatisfactory.

The amount of additional charge deposited on developed toner by a corona device, depends upon the toner's size, initial charge and polarity, and the amount of ac and dc corona current delivered to the region in the vicinity of the toner. To avoid overcharging the toner, a biased ac corona device is generally preferable to a dc device. The presence of both positive and negative ions in an ac corona discharge tends to equalize the charge among the toner particles due to the local electrostatic fields around the toner particles. In general, the change in the magnitude of the toner's charge for a given dc current into a region of the toner layer is also influenced by the magnitude of the ac current. If the toner layer is highly charged and the polarity of the dc component of the corona current flowing to the toner layer is the same as that of the toner, then the change in toner's charge for a fixed dc current will be smaller if an ac corotron is employed rather than a dc corotron.

Although there are ac corona current effects, it is the dc component of the corona current that is the dominant factor in determining how much net charge the toner receives in a given region. The dc current depends upon the ac current setpoint (for an ac corona device), the dc current setpoint, the potential at the toner layer surface prior to corona charging, and on the dielectric thickness of toner layer and photoconductor. Given the corona device characteristic, the dynamic dc current to a region moving past the charging device at a known speed can be modeled. However, here for purposes of illustration, it is sufficient to describe the dc current's behavior qualitatively.

The behavior of a corona device can be determined by measuring the current to a conductive plate as a function of the voltage applied to the plate (bare plate characteristics). In general, the bare plate characteristics (FIG. 3) for an ac corotron are such that the slope of the dc component of the current as a function of the plate potential is negative. As can been seen in FIG. 3, when the bare plate voltage increases in the negative direction, the negative dc current to the plate decreases (or the positivecurrent increases). This response is due simply to the change in the dc field between the corona wire and the bare plate. In a dynamic case, where a moving photoconductor with a developed toner on its surface is being charged, the situation is qualitatively similar to the bare plate case.

If an ac corotron is used to reverse the polarity of the negative toner in a discharged developed area of a tri-level image, disproportionatly more positive charge will be delivered to the toner that is already positive in the charged area developed parts of the composite image. This is just the opposite of what is desired because it makes it difficult to add enough charge to the negatively charged image parts to reverse their polarity without danger of overcharging the positively charged image parts.

It is well known in the prior art to subject a developed image on a charge retentive surface to corona discharge prior to image transfer for various reasons. For, example, U.S. Pat. No. 3,444,369 issued on May 13, 1969 relates to a method and apparatus for the reduction of background in transferred xerographic copy. A developed toner image on a photoconductive surface is subjected to a low level corona discharge of a polarity opposite the charge on the toner particles overlying the image areas. The corona discharge adjacent the image areas will be repelled by the like sign, but highly charged image areas of the photoconductive surface to thereby render the image area toner unaffected. The corona discharge adjacent the non-image areas of the photoconductive surface will not be repelled and will thus convert the toner overlying the non-image areas to a polarity opposite that on the image area toner particles. This will permit the electrostatic transfer of the image area toner, but will tend to suppress the transfer of the non-image area toner to a backing sheet.

It is also known to utilize light exposure and corona discharge prior to image transfer as shown in U.S. Pat. No. 4,506,971. In this device the light exposure occurs prior to the corona exposure. As stated therein, blurred images are minimized or eliminated in a xerographic reproduction prior to transfer by first exposing the image to light to at least substantially discharge the background around the image and to reduce the charge on the photoreceptor holding the image thereto. Secondly, a charge of opposite polarity of the charged photoreceptor is deposited onto the image and photoreceptor. This, as stated, produces a very stable image for transfer since a very strong holding force is produced to hold the image in place as the image enters the transfer station.

U.S. Pat. No. 3,784,300 issued on Jan. 8, 1974 relates to a copying apparatus with a pre-transfer station including a pre-transfer corotron and lamp arranged such that the light exposure of the photoreceptor is subsequent and not simultaneous with the pre-transfer corona charging.

U.S. Pat. No. 4,205,322 issued on May 27, 1980 relates to an electrostatic recording apparatus in which a toner image consisting of toner particles of at least two different kinds and of different polarities is efficiently and reliably transferred to a recording medium such as an ordinary sheet of paper. The toner particles having different polarities are all converted into those having one polarity and after such conversion the toner image (with its two kinds of particles) is electrostatically transferred to the recording medium, the transfer involving both kinds of particles at the same time.

BRIEF SUMMARY

Briefly, the present invention provides balanced, efficient corona transfer for both the charged area image and the discharged area image of a developed tri-level image. To this end, there is provided a selective pre-transfer charge corona device in combination with a pre-transfer discharge lamp. The purpose is to control the magnitude and distribution of pre-transfer current so that disproportionately more charge is added to the part of composite tri-level image that must have its polarity reversed to enable transfer compared to elsewhere on the image. While improved results over prior art devices are obtained using a pre-transfer lamp prior to pre-transfer charging the preferred embodiment of the invention utilizes a pre-transfer lamp before and in coincidence with the pre-transfer charging.

DETAILED DESCRIPTION OF THE PREFERRED EMBODIMENT OF THE INVENTION

Figure 2:
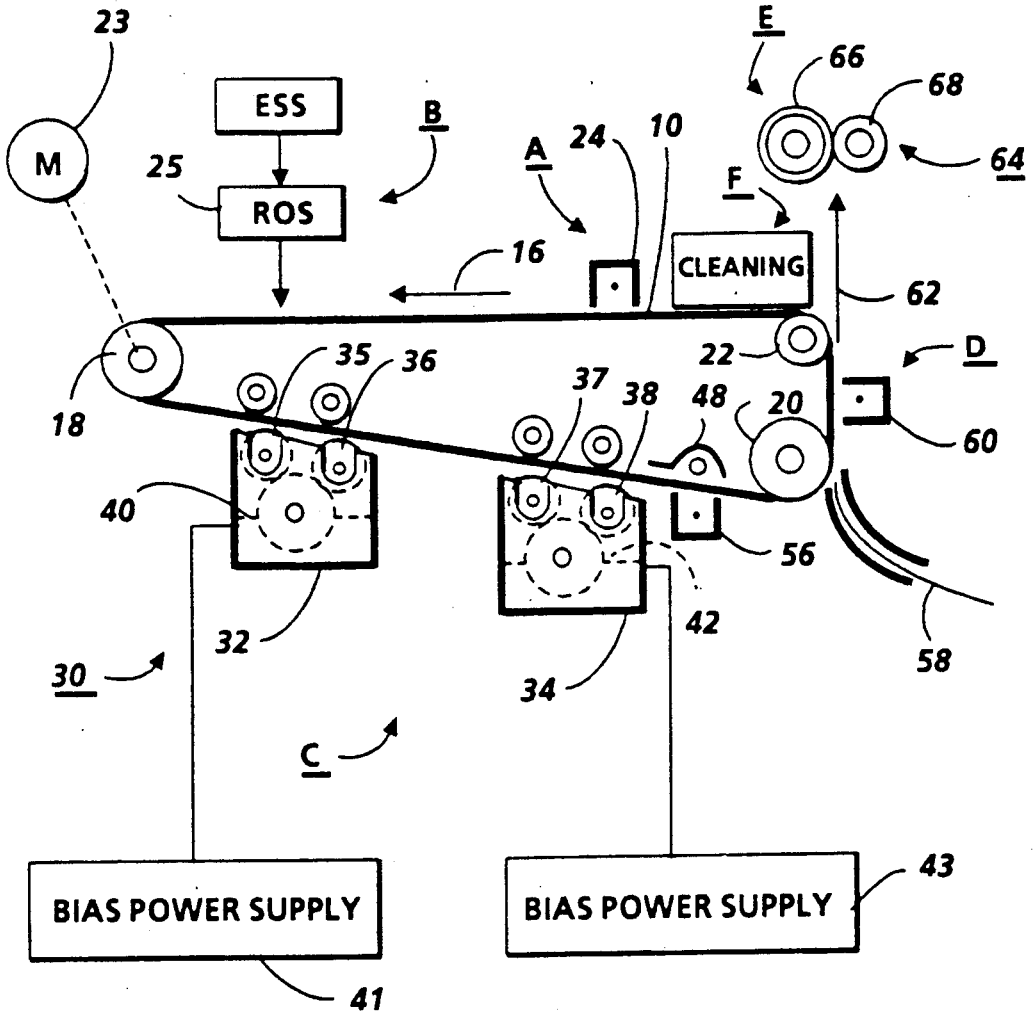
FIG. 2 is schematic illustration of a printing apparatus incorporating the inventive features of the invention.
Figure 3:
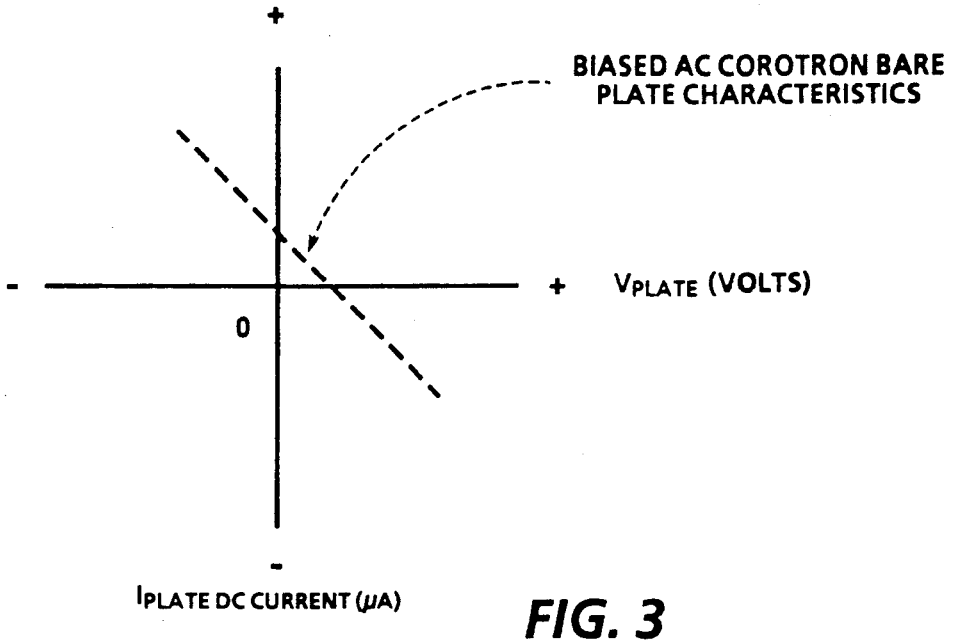
FIG. 3 is a plot of dc current versus plate voltage illustrating the conductive bare plate characteristics of a biased AC corotron.

As shown in FIG. 2, a printing machine incorporating the invention may utilize a charge retentive member in the form of a photoconductive belt 10 consisting of a photoconductive surface and an electrically conductive, light transmissive substrate and mounted for movement past a charging station A, an exposure station B, developer station C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

As can be seen by further reference to FIG. 2, initially successive portions of belt 10 pass through charging station A. At charging station A, a corona discharge device such as a scorotron, corotron or dicorotron indicated generally by the reference numeral 24, charges the belt 10 to a selectively high uniform positive or negative potential, $V_0$. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface 10 is exposed to a laser based output scanning device 25 which causes the charge retentive surface to be discharged in accordance with the output from the scanning device. Preferably the scanning device is a three level laser Raster Output Scanner (ROS). The resulting photoreceptor contains both charged-area images and discharged-area images as well as charged edges corresponding to portions of the photoreceptor outside the image areas.

Figure 1A:
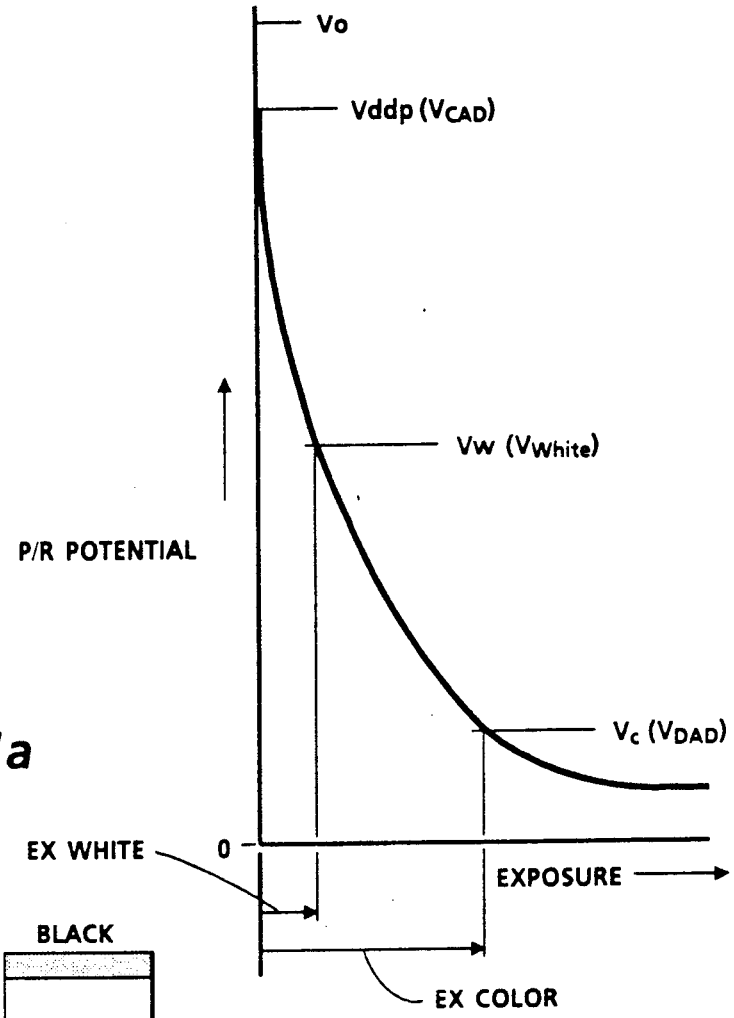
FIG. 1*a* is a plot of photoreceptor potential versus exposure illustrating a tri-level electrostatic latent image.
Figure 1B:
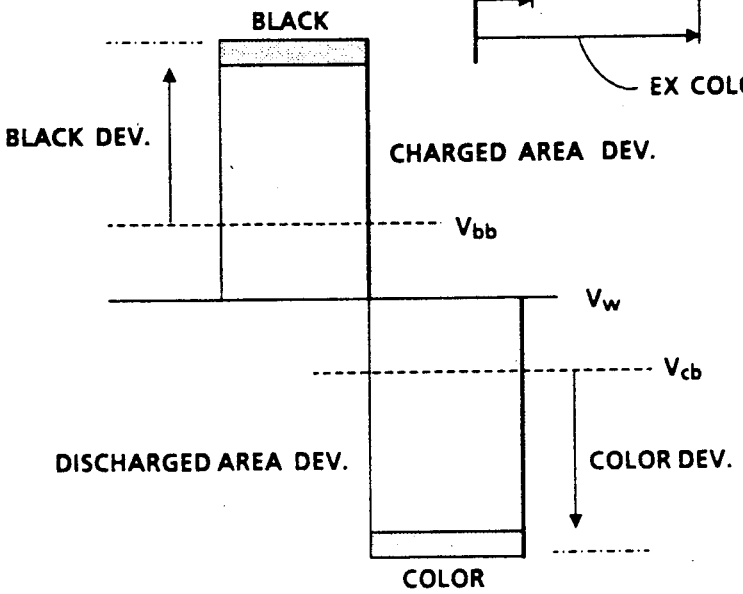
FIG. 1*b* is a plot of photoreceptor potential illustrating single-pass, highlight color latent image characteristics.

The photoreceptor, which is initially charged to a voltage $V_0$, undergoes dark decay to a level $V_{ddp}$ equal to about 900 volts. When exposed at the exposure station B it is discharged to $V_c$, equal to about 100 volts in the highlight (i.e. color other than black) color parts of the image. See FIG. 1*a*. The photoreceptor is also discharged to $V_w$ equal to 500 volts imagewise in the background (white) image areas. After passing through the exposure station, the photoreceptor contains charged areas and discharged areas which corresponding to two images and to charged edges outside of the image areas.

At development station C, a development system, indicated generally by the reference numeral 30 advances developer materials into contact with the electrostatic latent images. The development system 30 comprises first and second developer apparatuses 32 and 34. The developer apparatus 32 comprises a housing containing a pair of magnetic brush rollers 35 and 36. The rollers advance developer material 40 into contact with the photoreceptor for developing the discharged-area images. The developer material 40 by way of example contains negatively charged red toner. Electrical biasing is accomplished via power supply 41 electrically connected to developer apparatus 32. A DC bias of approximately 400 volts is applied to the rollers 35 and 36 via the power supply 41.

The developer apparatus 34 comprises a housing containing a pair of magnetic brush rolls 37 and 38. The rollers advance developer material 42 into contact with the photoreceptor for developing the charged-area images. The developer material 42 by way of example contains positively charged black toner for developing the charged-area images. Appropriate electrical biasing is accomplished via power supply 43 electrically connected to developer apparatus 34. A suitable DC bias of approximately 600 volts is applied to the rollers 37 and 38 via the bias power supply 43.

Because the composite image developed on the photoreceptor consists of both positive and negative toner, a lamp/reflector assembly 48 and a positive pre-transfer corona discharge member 56 are provided to condition the toner for effective transfer to a substrate using negative corona discharge. The pre-transfer corona discharge member is preferably an ac corona device biased with a dc voltage to operate in a field sensitive mode and to perform tri-level xerography pre-transfer charging in a way that selectively adds more charge (or at least comparable charge) to the part of composite tri-level image that must have its polarity reversed compared to elsewhere. This charge discrimination is enhanced by discharging the photoreceptor carrying the composite developed latent image with light before the pre-transfer charging begins. Furthermore, flooding the photoreceptor with light coincident with the pre-transfer charging minimizes the tendency to overcharge portions of the image which are already at the correct polarity.

The reflector forming a part of assembly 48 is preferably designed to reflect light through the light transmissive substrate of the photoreceptor 10 in an area preceding the corona discharge member 56 and in an area immediately opposite the member 56.

A sheet of support material 58 is moved into contact with the toner image at transfer station D. The sheet of support material is advanced to transfer station D by conventional sheet feeding apparatus, not shown. Preferably, the sheet feeding apparatus includes a feed roll contacting the uppermost sheet of a stack copy sheets. Feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station D.

Transfer station D includes a corona generating device 60 which sprays ions of a suitable polarity onto the backside of sheet 58. This attracts the charged toner powder images from the belt 10 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a backup roller 68. Sheet 58 passes between fuser roller 66 and backup roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station F. A magnetic brush cleaner housing is disposed at the cleaner station F. The cleaner apparatus comprises a conventional magnetic brush roll structure for causing carrier particles in the cleaner housing to form a brush-like orientation relative to the roll structure and the charge retentive surface. It also includes a pair of detoning rolls for removing the residual toner from the brush.

Subsequent to cleaning, a discharge lamp (not shown) floods the photoconductive surface with light to dissipate any residual electrostatic charge remaining prior to the charging thereof for the successive imaging cycle.

Figure 4A:
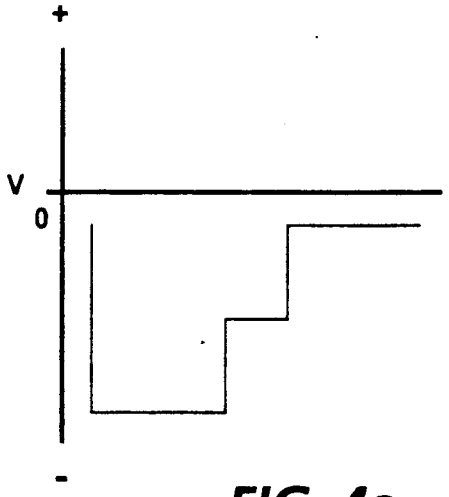
FIG. 4*a* is a plot of photoreceptor potential versus photoreceptor position for a photoreceptor which has not been exposed to a pre-transfer light.
Figure 4B:
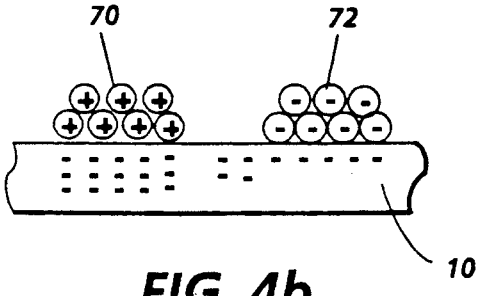
FIG. 4*b* is fragmentary view of a photoreceptor illustrating the charge distribution thereon according to the plot in FIG. 4*a;*

In order to better understand our invention, the tri-level case of a negatively charged photoconductor will be described with reference to FIGS. 4*a* through 5*b*. Before light treatment, the voltage situation is such that the charge retentive surface 10 has a high negative charge thereon beneath the positive toner image 70 as shown in FIGS. 4*a* and 4*b*. The voltage above the positive toner layer is more negative than above the negative toner image layer 72 with no pre-transfer light prior to the pre-transfer corotron and hence the pre-transfer corotron will deliver more positive dc current to the positively charged toner regions than the negatively charged region.

Figure 5A:
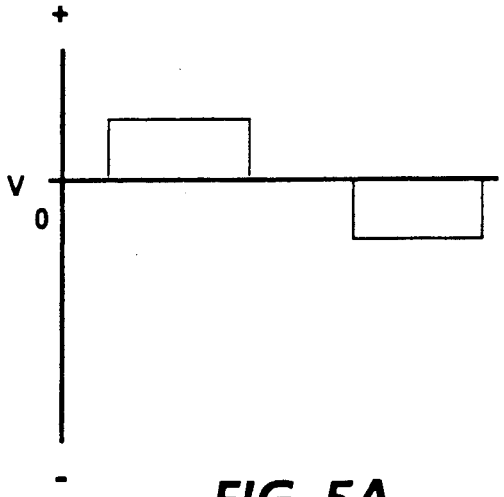
FIG. 5*a* is a plot of photoreceptor potential versus photoreceptor position for a photoreceptor which has been exposed to a pre-transfer light.
Figure 5B:
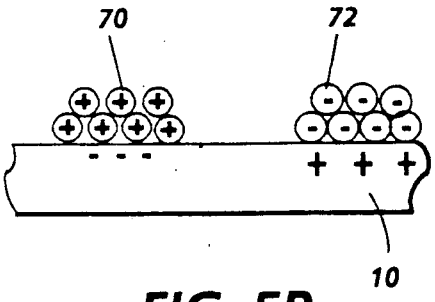
FIG. 5*b* is a fragmentary view of a photoreceptor illustrating the charge distribution thereon according to the plot in FIG. 4*b*.

By exposing the images to light prior to pre-transfer charging, the voltage situations prior to pre-transfer corona charging are such as to substantially reduce the aforementioned high negative charge as depicted in FIGS. 5*a* and 5*b*. With a high intensity pre-transfer light exposure prior to the corotron discharge, the positively charged toner regions receive less (or at least comparable) positive current flow from the pre-transfer corotron than the negatively charged toner region, which is the desired result.

Another benefit is provided by flooding the photoreceptor with light coincident with the pre-transfer charging step. For a negative charging photoreceptor like that disclosed in U.S. Pat. No. 4,265,990, the pre-transfer charging device will be supplying positive charge to the negative toner portions of the composite tri-level image to convert its polarity. Because the light makes the photoreceptor conduct, any charge reaching the photoreceptor surface will pass through to the ground plane. It has been found that toner sitting on a conductive surface will not accumulate as much charge as toner sitting on an insulative surface. This is believed to be due to "charge scattering" by the local electric fields generated by the toner charges themselves. The result of the charge scattering effect is to funnel charge through the voids in the toner pile to the photoreceptor surface when the toner charge becomes large. If the photoreceptor surface were not conductive, charge would accumulate at the photoreceptor surface and the local electric fields responsible for funneling charge through the toner pile would be neutralized, thereby quenching the funneling effect and allowing the toner charge to increase.

The field sensitive corona device 56 effects tri-level xerography pre-transfer charging in a way that selectively adds more charge to the part of composite tri-level image that must have its polarity reversed than to the rest of the image. This then allows both parts of the composite tri-level image to be corona transferred to paper with comparable efficiencies. We have shown that a dc biased, ac corotron, properly designed and operated, can perform this function so that the composite tri-level image has a transfer efficiency $>80\%$ without incurring image defects caused by overcharging any part of the image. Use of the field sensitive device 56 in combination with a pre-transfer erase lamp provides a wider operating window in some circumstances. Another appropriate means to differentially control the amount of charge delivered to a composite tri-level image is with a dc or ac scorotron.

Discharging the photoreceptor coincident with pre-transfer charging in tri-level xerography has the beneficial effect of minimizing the tendency to overcharge portions of the image.

What is claimed is:

1. The method of conditioning tri-level images for transfer from a charge retentive member to a substrate, said method including the steps of:

exposing tri-level images on one surface of a charge retentive member to a source of illumination; and subsequent to said preceding step, simultaneously exposing said tri-level images to a source of illumination and corona discharge.

2. The method according to claim 1 wherein said steps of exposing said tri-level images to a source of illumination is effected adjacent the non-imaged surface of said charge retentive member.

3. The method according to claim 2 wherein said steps of exposing said tri-level images to a source of illumination is effected using the same source of illumination.

4. The method according to claim 3 wherein said step of exposing said tri-level images to corona discharge is accomplished using a field sensitive discharge device.

5. The method according to claim 4 wherein said step of exposing said tri-level images to corona discharge is accomplished using a dc biased ac corona device.

6. Apparatus for conditioning tri-level images for transfer from a charge retentive member to a substrate, said apparatus comprising:

means for exposing tri-level images on one surface of a charge retentive member to a source of illumination;

means for simultaneously exposing said tri-level images to a source of illumination and corona discharge; and means for moving said charge retentive surface sequentially past said means for exposing and said means for simultaneously exposing.

7. Apparatus according to claim 6 wherein said means for exposing said tri-level images to a source of illumination is positioned adjacent the non-imaged surface of said charge retentive member.

8. Apparatus according to claim 7 wherein said means for exposing said tri-level images to a source of illumination comprises a single source of illumination.

9. Apparatus according to claim 8 including a reflector for said illumination source which directs illumination from said source to an area of said charge retentive member positioned opposite said means for exposing said tri-level images to corona discharge and to a location preceding said area of said charge retentive member positioned opposite said means for exposing said tri-level images to corona discharge.

10. Apparatus according to claim 8 wherein said means for exposing said toner images to corona discharge comprises a field sensitive device.

11. Apparatus according to claim 8 wherein said means for exposing said toner images to corona discharge comprises a dc biased ac corotron.

* * * * *